United States Patent [19]

Wesselink et al.

[11] 4,157,485

[45] Jun. 5, 1979

[54] LOW-PRESSURE MERCURY VAPOR DISCHARGE LAMP WITH INDIUM-BISMUTH-MERCURY AMALGAM

[75] Inventors: Gustaaf A. Wesselink; Pieter Hokkeling, both of Eindhoven, Netherlands

[73] Assignee: U.S. Philips Corporation, New York, N.Y.

[21] Appl. No.: 695,870

[22] Filed: Jun. 14, 1976

[30] Foreign Application Priority Data

Jun. 20, 1975 [NL] Netherlands ..... 7507357

[51] Int. Cl.[2] ..... H01J 61/28; H01J 61/72

[52] U.S. Cl. ..... 313/174; 313/490; 316/5; 427/423

[58] Field of Search ..... 313/490, 174; 316/5; 427/423

[56] References Cited

U.S. PATENT DOCUMENTS

| | | | |
|---|---|---|---|
| 3,152,278 | 10/1964 | Dziergwa et al. | 313/490 X |
| 3,436,248 | 4/1969 | Dittrich et al. | 427/423 |
| 3,526,804 | 9/1970 | Evans et al. | 313/490 X |
| 3,742,278 | 6/1973 | Shindelman et al. | 313/174 X |
| 3,890,531 | 6/1975 | Panofski et al. | 313/490 |

*Primary Examiner*—Palmer C. Demeo

*Attorney, Agent, or Firm*—Robert S. Smith

[57] ABSTRACT

A low-pressure mercury vapor discharge lamp having a discharge space provided with two thermally emitting electrodes as well as an amalgam of bismuth, indium and mercury, characterized in that the ratio of atoms of bismuth to atoms of indium is between 0.4:0.6 and 0.7:0.3 and the ratio of atoms of mercury to the sum of the atoms of bismuth and indium is between 0.01:0.99 and 0.15:0.85.

5 Claims, 3 Drawing Figures

LOW-PRESSURE MERCURY VAPOR DISCHARGE LAMP WITH INDIUM-BISMUTH-MERCURY AMALGAM

The invention relates to a low-pressure mercury vapour discharge lamp having a discharge space which comprises two thermally emitting electrodes as well as an amalgam of bismuth, indium and mercury.

Low-pressure mercury vapour discharge lamps have a maximum efficiency of converting the electric energy supplied into ultraviolet radiation when the mercury vapour pressure amounts to approximately $6\times10^{-3}$ torr in the operating conditions, which corrresponds to a vapour pressure which is in equilibrium with mercury having a temperature near 40° C.

The temperature of a discharge lamp is mainly determined by the power supplied to the lamp and by the quantity of heat which the lamp dissipates, especially owing to radiation, into the environment in which it burns. If the ambient temperature of the lamp exceeds that ambient temperature at which the discharge space of the lamp gets a temperature of approximately 40° C. at the prescribed power supplied to it, then the above-mentioned conversion efficiency decreases. As it is in most cases difficult to keep the ambient temperature constant the conversion efficiency and consequently the light output of the lamps varies, if no special measures are taken. The temperature of the lamp may, for example, rise if the lamp is used in a luminair in which the temperature assumes too high a value owing to insufficient ventilation. In principle it is therefore impossible to design a lamp which, at a predetermined power supplied to it always has an optimum light output at any ambient temperature.

Also when the supply of electric energy is increased to increase the radiant efficiency the mercury vapour pressure rises owing to the higher temperature of the lamp occurring therewith, so that the conversion efficiency decreases.

A known method to maintain the mercury vapour pressure in a discharge space as constant as possible, in spite of an increase of the temperature due to one of the above-mentioned causes is to use a mercury amalgam. This amalgam is applied in the lamp in a place which assumes a temperature at the prescribed operating conditions of the lamp which is such that the mercury vapour pressure prevailing above the amalgam assumes a value which deviates as little as possible from $6\times10^{-3}$ torr. This temperature exceeds 40° C.

A known amalgam which may be used is composed of indium and mercury. By using such an amalgam, which has a given ratio of indium and mercury, the mercury vapour pressure remains reasonably stable around $6\times10^{-3}$ torr over a fairly wide temperature range. At lower percentages of mercury in the amalgam the temperature range over which the value of the mercury vapour pressure is substantially stable becomes still wider, but, the difficulty then arises that the value around which the mercury vapour pressure then stabilizes becomes higher than the optimum value of $6\times10^{-3}$ torr which causes the conversion efficiency of electrical energy into useful radiation to decrease.

It is known that at room temperature lamps with an amalgam, particularly of indium and mercury do not ignite so readily as lamps without amalgam. The reason is that at room temperature the mercury vapour pressure is lower than for lamps having pure mercury. The lower the mercury content in the amalgam the lower the mercury vapour pressure at room temperature and the poorer the ignition.

During operation of the lamp the percentage of mercury in the amalgam becomes increasingly lower as part of the mercury becomes bound, particularly by absorption in a fluorescent layer which is present in many cases.

Thus the use of an amalgam of indium and mercury results in that the temperature range in which the pressure stabilizes becomes indeed wider but that the ignition becomes increasingly more difficult and the efficiency decreases.

It is an object of the invention to obviate these drawbacks.

A low-pressure mercury vapour discharge lamp according to the invention contains an amalgam of bismuth, indium and mercury and is characterized in that the ratio of atoms of bismuth to atoms of indium is between 0.4:0.6 and 0.7:0.3 and the ratio of atoms of mercury to the sum of the atoms of bismuth and indium is between 0.01:0.99 and 0.15:0.85.

A low-pressure mercury vapour discharge lamp which contains an amalgam of the above-mentioned composition has the advantage that the mercury vapour pressure remains reasonably stable over a wide temperature interval around $6\times10^{-3}$ torr.

Another advantage of the use of an amalgam of indium, bismuth and mercury is, that at room temperature the mercury vapour pressure is sufficiently high to guarantee a ready ignition of a lamp provided with this amalgam. Furthermore, the use of this amalgam has the advantage that if the percentage of mercury in the amalgam becomes lower in the course of operation of the lamp, for example owing to absorption of mercury in the fluorescent layer, the ignition is not impeded because at room temperature the mercury vapour pressure has become lower. Also the value of the mercury vapour pressure where the efficiency is optimum shifts only little in the course of operation of the lamp.

German Pat. No. 1,149,818 mentions a number of amalgams which consist of a combination of mercury and indium with tin or bismuth or with tin and cadmium. In order to obtain a proper adhesion during the application and a proper plasticity of such amalgams the condition must be satisfied according to the German Patent that the ratio of the amalgam-forming metals to the mercury is between 4:1 and 1:1. It is furthermore indicated for the amalgam consisting of mercury, indium and tin that the ratio of tin and indium to mercury should preferably be 2.5:1. It is also indicated that in this amalgam, which is preferably chosen the ratio of tin to indium is 47 to 53, expressed in a percentage by weight. Converted into a percentage of atoms this ratio is 46:54. It is not indicated how this ratio must be chosen when bismuth or cadmium is used.

As it is an important requirement in the above-mentioned German Patent that the adhesion of the amalgam to the wall must be good the percentage of mercury in the amalgam must, according to the Patent, be relatively large. This results in that the mercury vapour pressure variation as a function of the temperature is substantially equal to that for pure mercury.

As mentioned above it is possible to apply the amalgam as a whole in the discharge space but it is also possible to apply the remaining components separate from the mercury. Such a method has the advantage that the quantity of mercury can be dosed very accurately, for example by means of an mercury capsule applied in the lamp as described in the British Pat. No. 1,267,175. The alloy of indium and bismuth is applied in a suitable place in the lamp, for example at the so-called stem. For an alloy consisting of indium and bismuth in the atomic ratios according to the invention the adhesion to glass parts of the lamp, for example the stem, is very good.

A ratio of atoms of bismuth to atoms of indium between 0.45:0.55 and 0.60:0.40, being close to the eutectic mixture 0.53:0.47 is particularly advantageous as then the above-mentioned ratios are minimally disturbed by de-mixing.

By choosing the ratios of atoms of mercury to the sum of the atoms of bismuth and indium to be between 0.04:0.96 and 0.10:0.90 a substantially flat course of the vapour pressure curve as a function of the temperature is ensured. Then the mercury vapour pressure is appromimately $6\times10^{-3}$ torr. If the relative quantity of mercury is chosen to be higher than 0.20 the vapour pressure stabilizing action will be substantially cancelled and the luminous flux will decrease relatively more at higher temperatures.

In the manufacture of a lamp according to the invention an alloy of indium and bismuth may, as stated above, be applied separate from the mercury.

One of the problems which arise in such a method is that an alloy of indium and bismuth has a brittle character at room temperature. This results in that the mechanical application of such an alloy on a glass part of the lamp is very difficult. This drawback can be mitigated by using the alloy in the form of a wire, obtained by hot extrusion. Then use is made of the fact that an alloy of indium and bismuth is reasonably ductile at temperatures over 100° C. and so suitable for hot extrusion. The brittle alloy in the form of a rod is therefore extruded to form a wire at a temperature of approximately 60° C. through an extrusion opening at an angle of at least 90°, preferably 120°; a wire obtained in this manner maintains its ductile character for a long time also at room temperature.

In the manufacture of a lamp a length of this wire is sprayed at a temperature just above the melting point onto that place in the lamp where the alloy must be applied, such as, for example, on the stem.

The invention will now be described with reference to a drawing.

In the drawing

Figure 1:
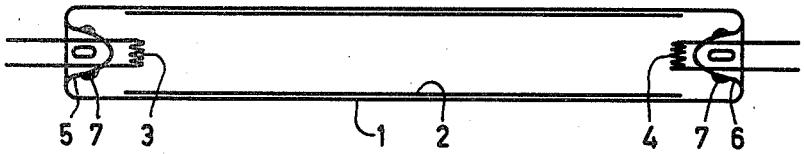
FIG. 1 is a diagrammatical cross-section of a low-pressure mercury vapour discharge lamp provided with an amalgam according to the invention.

The lamp shown in FIG. 1 has a glass envelope 1 provided with a luminescent coating 2, for example manganese and antimony-activated calcium halophosphate. The lamp is filled with mercury vapour and a rare gas or a combination of rare gases, for example argon and neon at a pressure of 4 to 6 torr. Thermally emitting electrodes 3 and 4 are provided at the ends of the discharge space. In the discharge space a quantity of between 20 mg and 600 mg of an alloy of indium and bismuth 7, which may form an amalgam with mercury is provided on each stem 5 and 6 respectively.

Figure 2:
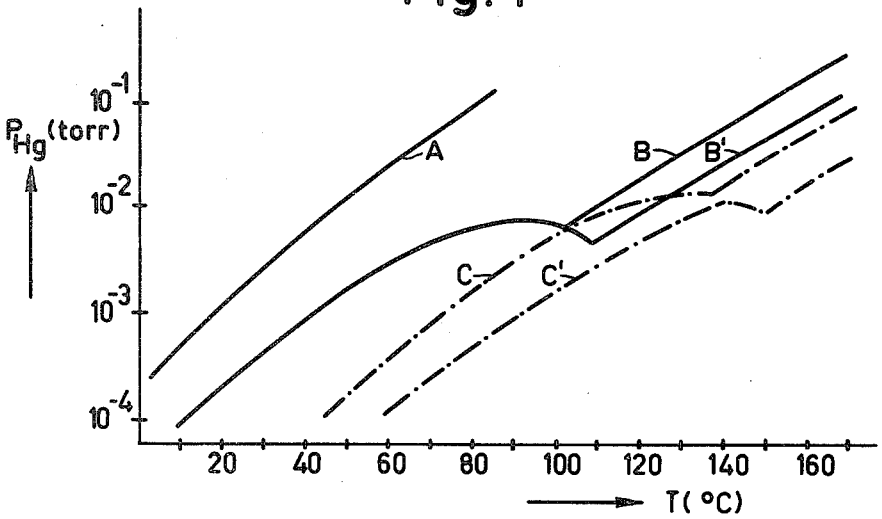
FIG. 2 shows a graphic representation of the mercury vapour pressure plotted logarithmically as a function of the temperature for, respectively, pure mercury, an amalgam of indium and mercury and an amalgam of indium, bismuth and mercury.

In FIG. 2 the curve which indicates the mercury vapour pressure over pure mercury as a function of the temperature is indicated by the curve A. The temperature of the mercury is, of course, the temperature within the lamp envelope curve which indicates the mercury vapour pressure of an amalgam of indium, bismuth and mercury as a function of the temperature is indicated by B and B′ respectively. Curve B shows the vapour pressure for a ratio in atoms of indium, bismuth and mercury of 45:49:6. Curve B′ relates to a mercury vapour pressure of an amalgam having an atomic ratio of 46:51:3. Curves C and C′ relate to the mercury vapour pressure as a function of the temperature over amalgams of indium and mercury having a ratio of 94:6 and 97:3 respectively. It can be seen from this graph that the vapour pressure of an amalgam is always lower than that of pure mercury. It furthermore appears that the curves B and B′ have a flatter curve over a large temperature range around the optimum value of $6\times10^{-3}$ torr than the curves C and C′. It furthermore appears that the vapour pressure at room temperature is higher for an amalgam of indium, bismuth and mercury than for amalgams of indium and mercury. The result is that the lamps provided with the first-mentioned amalgams ignite more readily. It can also be seen from this graph that if the percentage of mercury in the amalgam decreases, the temperature range where the vapour pressure stabilizes becomes indeed wider but that the mercury vapour pressure at room temperature is independent of the percentage mercury in the compound indium, bismuth and mercury. So the ignition of the lamp is equally well for all compounds. It appears from the graph that this is not the case for amalgams of indium and mercury.

Figure 3:
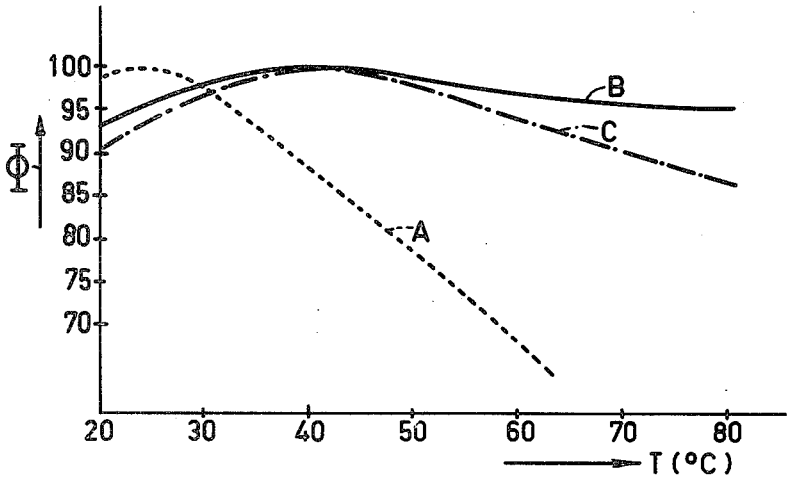
FIG. 3 shows a graphic representation of the luminous flux $\phi$ as a function of the ambient temperature T of lamps which have been provided or not provided with an amalgam of the above-mentioned compositions.

FIG. 3 shows luminous flux curves for lamps which all have the same load, the maximum flux being set at 100 arbitrary units for convenience. The curve A represents the luminous flux as a function of the ambient temperature of lamps which only contain pure mercury. Curve B shows the corresponding case for lamps provided with an amalgam of indium, bismuth and mercury in a ratio of 45:49:6. Curve C shows the case for lamps provided with an amalgam of indium and mercury in a ratio of 94:6. It appears from this graph that the luminous flux of lamps provided with an amalgam according to the invention remains high over a wide temperature range.

What is claimed is:

1. A low-pressure mercury vapour discharge lamp comprising a sealed glass envelope, two thermally emitting electrodes separated by a discharge space and an amalgam, said electrodes discharge space and amalgam being disposed in said envelope, said amalgam consisting of bismuth, indium and mercury, the ratio of atoms of bismuth to atoms of indium being between 0.4:0.6 and 0.7:0.3 and the ratio of atoms of mercury to the sum of the atoms of bismuth and indium is between 0.01:0.99 and 0.15 :0.85.

2. A low-pressure mercury vapour discharge lamp as claimed in claim 1, wherein the ratio of atoms of bismuth to atoms of indium is between 0.45:0.55 and 0.60:0.40.

3. A low-pressure mercury vapour discharge lamp as claimed in claim 1 having a ratio of atoms of mercury to the sum of the atoms of bismuth and indium between 0.04:0.96 and 0.10 :0.90.

4. A method for producing a low-pressure mercury vapour discharge lamp as claimed in claim 1 comprising: providing the alloy of indium and bismuth, extruding the alloy in the form of a rod to form a ductile wire at a temperature of approximately 60° C. through an extrusion opening having an angle of at least 90° and then spraying the wire at a temperature just above the melting point onto a location in the lamp where it is desired to deposit the alloy.

5. A method as claimed in claim 4 wherein said extrusion opening has an angle of about 120°.

* * * * *